US008708245B2

(12) United States Patent
Jobe

(10) Patent No.: US 8,708,245 B2
(45) Date of Patent: Apr. 29, 2014

(54) CONTROLLED-FRICTION TRACK FOR GRAVITY RACE CARS

(76) Inventor: John Dewey Jobe, Missouri City, TX (US)

( * ) Notice: Subject to any disclaimer, the term of this patent is extended or adjusted under 35 U.S.C. 154(b) by 0 days.

(21) Appl. No.: 13/385,518

(22) Filed: Feb. 23, 2012

(65) Prior Publication Data

US 2013/0221119 A1 Aug. 29, 2013

(51) Int. Cl.
*E01B 23/00* (2006.01)
*A63H 18/14* (2006.01)

(52) U.S. Cl.
USPC ..... 238/10 B; 446/445

(58) Field of Classification Search
USPC ..... 238/10 R, 10 B, 10 C, 10 E, 10 F; 446/444–447
See application file for complete search history.

(56) References Cited

U.S. PATENT DOCUMENTS 7,938,068 B2 * 5/2011 Parker et al. ..... 104/53

* cited by examiner

*Primary Examiner* — R. J. McCarry, Jr.

(57) ABSTRACT

The present invention comprises an improved track which increases the speed of a gravity-driven racing car. Firstly, a micro-grooved wheel rolling surface increases the friction for lateral movement of the car wheels through a fingerprint effect, thus straightening the trajectory of the path to the finish line. Secondly, this effect also reduces the amount of sideways movement towards the central guide strip and the associated bumping velocity. Thirdly, a low-friction material on the central guide strip reduces the frictional drag when contacted by a car's wheels. Fourthly, the micro-grooved surface also reduces the contact area between the wheel and the track surface causing a reduction in rolling friction. Finally, the micro-grooved rolling surface in combination with the low-friction guide strip material have a synergistic effect since the coefficient of sliding friction between a wheel and low-friction guide strip material is lessened because of a reduction in lateral velocity of contact.

8 Claims, 4 Drawing Sheets

FIG. 7
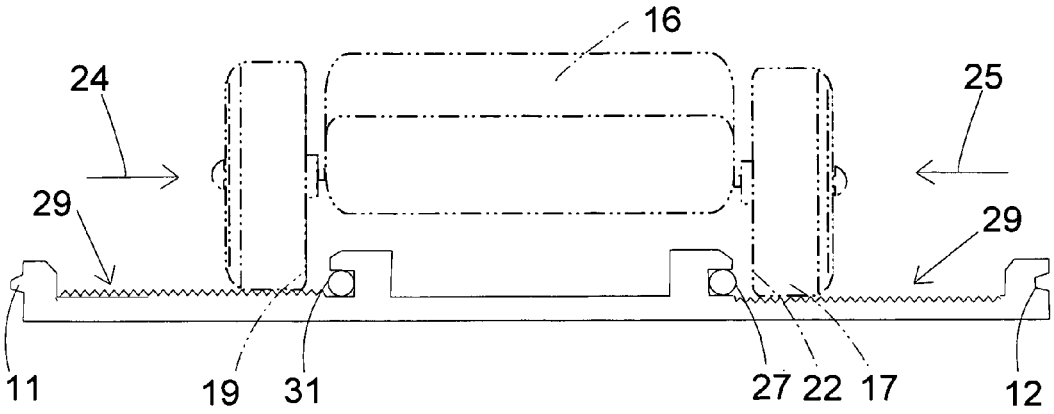
FIG. 8
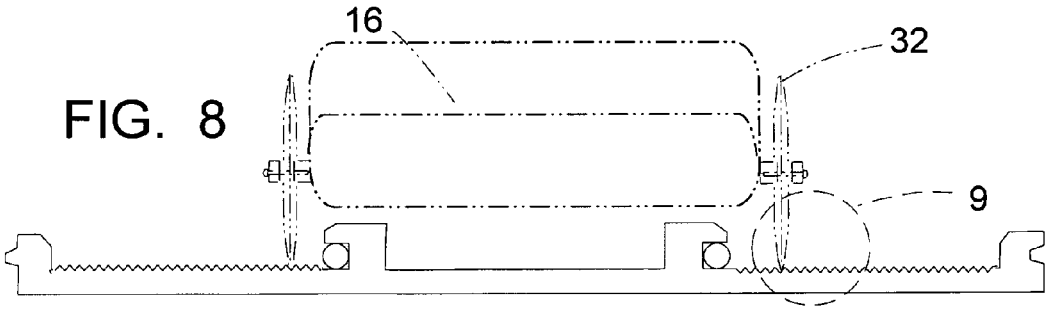
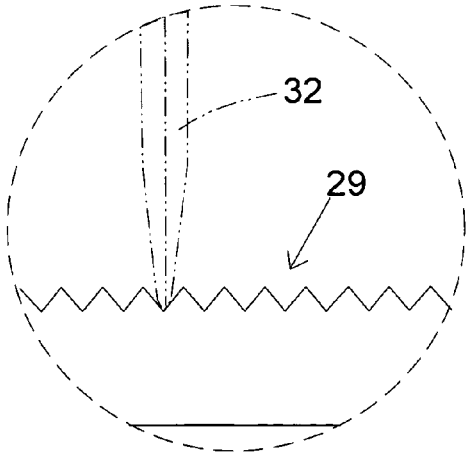
FIG. 9

| COEFFICIENT OFSLIDING FRICTION (COF) | | | | |
|---|---|---|---|---|
| | Surface 1 Wheel | Surface 2 Track | Direction | COF |
| Row | Smooth | * Smooth | Cross or Down-Track | |
| 1 | | Al -Grooved | Cross | 1.25 |
| 2 | PS | Al* | Both | 0.34 |
| 3 | PS | PS* | Both | 0.31 |
| 4 | PS | PE* | Both | 0.34 |
| 5 | PS | Teflon®* | Both | 0.040 |
| 6 | PS | HDPE* | Both | 0.039 |
FIG. 10A
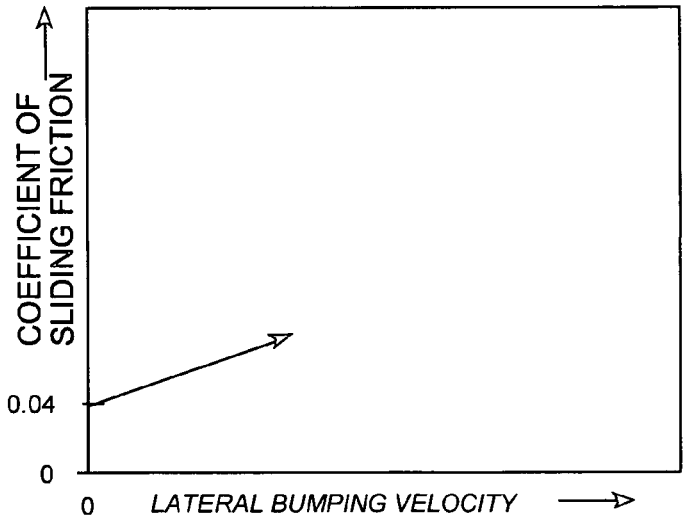
FIG. 10B
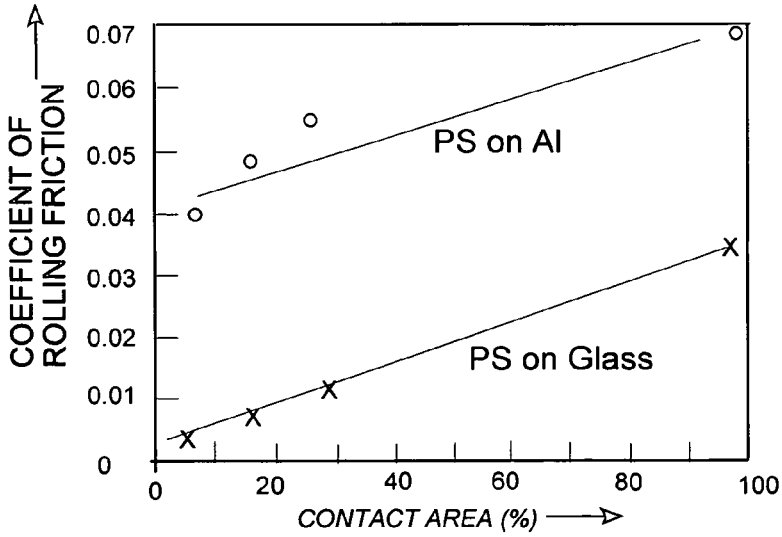
FIG. 10C

CONTROLLED-FRICTION TRACK FOR GRAVITY RACE CARS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to gravity-driven car racing, specifically an improved track based on a controlled-friction design for use in racing such as the popular Pinewood Derby race.

2. Prior Art

Millions of Pinewood Derby races have been run since the inception of the race in 1953, mostly by Cub Scouts and their parents. But the currently available race tracks have a problem in that friction between the car wheels and the track is not controlled. Refer to the prior art FIGS. 1 and 2 which point out views typical of ramps currently in use that do not control friction. In one commonly used ramp in FIG. 1, the ramp material used to form either one lane or several side-by-side lanes has uncontrolled regions where the level of friction between the track and the wheels of a gravity-driven car limit the potential performance of the car. In some areas friction between the race car's wheels and the track should be increased and in other areas it should be decreased. Careful examination of a car during racing shows the following prior art problem areas:

1) In a race car's guiding process, the car wheels must straddle the center guide strip from start to finish. The friction level between the wheel and the smooth flat surface of the wheel rolling channel is too low allowing traction loss and undesirable side-to-side cross-track movement of a car. This causes bumping against the center guide strip, here formed from 2 guide rails, resulting in a loss of energy and car speed. Moreover, the distance a car must travel to reach the finish line increases as guide strip bumping increases, also resulting in a slower race time.
2) During the guiding process there is too much friction from the inside of the car wheels rubbing against the center guide strip which causes loss of speed even in the absence of direct bumping.
3) There is an adhesive force between a car wheel's flat tread and the flat track surface, commonly called rolling friction, which also results in a loss of car speed.

Refer now to FIG. 1 Prior Art where a lane section 10 has connecting pins such as 14 for end-to-end joining with other sections and also a tongue 11 and groove 12 for side-by-side lane joining. The lane has flat wheel rolling channels such as 15 for the wheels and a central guide strip as shown here formed by a pair of raised guide rails such as 13. Extruded aluminum or plastic are commonly used materials for the prior art tracks.

In FIG. 2 there is shown an end-view, from the front, outline of a car body 16 on the prior art track of FIG. 1. More detail on the problems caused by the above three friction areas are:

a) In FIG. 2 we see where prior art tracks can have a low friction that exists in the area 23 where the wheel smooth bottom surface contacts the smooth flat rolling channel surface 18. This low friction allows a force, such as those commonly encountered during racing dynamics, to increase the motion 25 when traction is lost. This can result in a substantial impact when the wheel inside 22 bumps against the guide rail 21 as explained in 1) above. The same effect applies to the motion 24 and impact between surfaces 19 and 20 on the car's passenger side. In addition to the energy loss and car forward speed reduction from the central guide strip bumping, the sideways motion itself detracts from a straight path and increases the time to the finish line.

b) Again, in FIG. 2, the movement 25 of the body and an attached car wheel 17 can be more gradual. This movement causes the inside of the wheel, 22, to rub against the outside, 21, of the guide rail 13. The wheel is a plastic material, usually polystyrene, which can develop considerable rubbing force from this sliding friction with the guide rail which slows down the speed of the car. Similarly, movement 24 of the body and attached car wheel on the passenger-side of the car causes the inside surface of this wheel, 19, to rub against the outside, 20, of the guide rail on the passenger side. Sometimes a car will alternate sides when contacting the guide rail with its wheels on its way to the finish line. At other times, depending on the wheel alignment, it is possible for wheels on only one side of the car to rub the guide rail for a substantial part of the distance from start to the finish.

c) The wheel "foot print" is a relatively large contact area between the flat and smooth wheel tread surface 23 and the smooth rolling surface 18 which contributes to an adhesive force between these surfaces that requires energy to separate. This adhesive force operates perpendicular to the wheel channel rolling surface whereas the sliding friction in 1) and 2) above is a tangential force opposite to the direction of motion. This adhesive force, sometimes known as rolling friction, is unlike sliding friction in that it does depend on the contact area 23.

SUMMARY

The present invention controls several areas of friction found when using prior art tracks, all of which reduce car speed. We have firstly introduced a micro-grooved wheel rolling surface which increases friction for cross-track movement of the car wheels. This improves traction, reduces center guide strip bumping velocity, reduces energy loss and improves race time. Secondly, the reduction in cross-track movement straightens the car's path also improving race times. Thirdly, a low-friction material on the central guide strip reduces frictional drag when contacted by a car's wheels. Fourthly, the micro-grooved surface also reduces the contact area between the wheel and the track surface causing a reduction in rolling friction. Finally, the micro-grooved rolling surface in combination with the low-friction guide strip material have a synergistic effect since the coefficient of sliding friction between a wheel and the low-friction guide strip material is lessened by a reduction in the guide strip bumping velocity.

DRAWINGS—FIGURES

FIG. 7 shows the preferred embodiment of the track and its interaction points with a car.

FIG. 8 shows a car with racing wheels on the preferred embodiment of the track.

FIG. 9 shows an enlarged view of the racing wheels and the micro-grooved surface.

FIG. 10A shows a table of coefficients of friction (COF) for polystyrene (PS) on other materials.

FIG. 10B shows Teflon® or HDPE COF on PS tends to increase with bumping velocity.

FIG. 10C shows that the coefficient of rolling friction increases with contact area.

DRAWINGS—REFERENCE NUMERALS

11—tongue
12—groove
13—driver side guide rail
14—connecting pin
15—flat wheel rolling channel
16—car body front view
17—flat tread car wheel
18—wheel rolling channel surface
19—inner tread surface of passenger-side wheel
20—passenger-side outer edge guide strip surface
21—driver-side outer edge guide strip surface
22—inner tread surface of driver-side wheel
23—contact area between wheel 17 tread surface and rolling channel surface 18
24—movement from passenger-side force
25—movement from driver-side force
26—grooved driver-side guide rail part of central guide strip
27—low-friction polymer rod insert driver side
28—groove in 26 to contain polymer rod 27
29—micro-grooved extrusion of wheel rolling surface
30—direction arrow showing insertion of rod 27 into groove 28
31—low-friction polymer rod insert passenger-side
32—custom sharp-tread racing wheel
33—grooved passenger-side guide rail part of central guide strip

DETAILED DESCRIPTION OF A PREFERRED EMBODIMENT

FIGS. 3-10

Micro-grooved Wheel Rolling Surface

Figure 3:
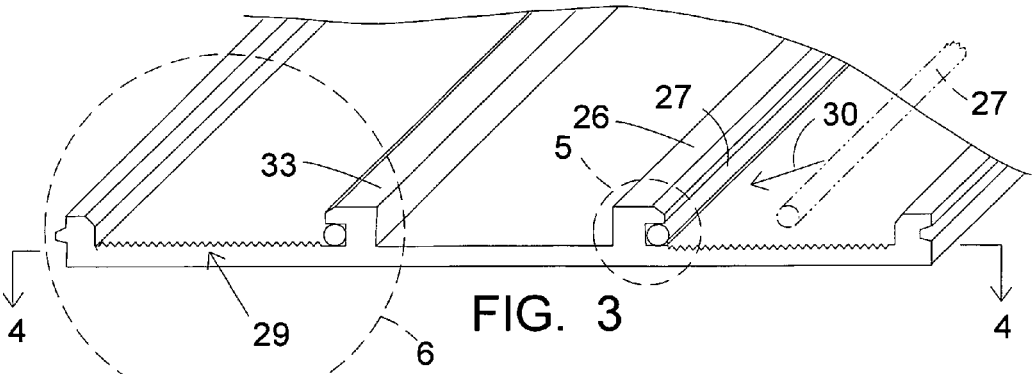
FIG. 3 shows the present track embodiment in 3-D appearance.
Figure 4:
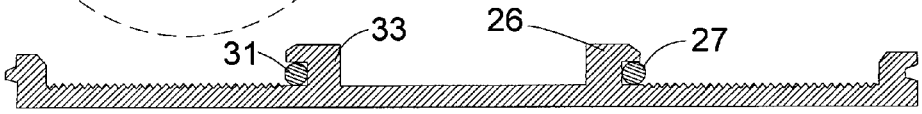
FIG. 4 shows a cross section view of the track in FIG. 3.
Figure 6:
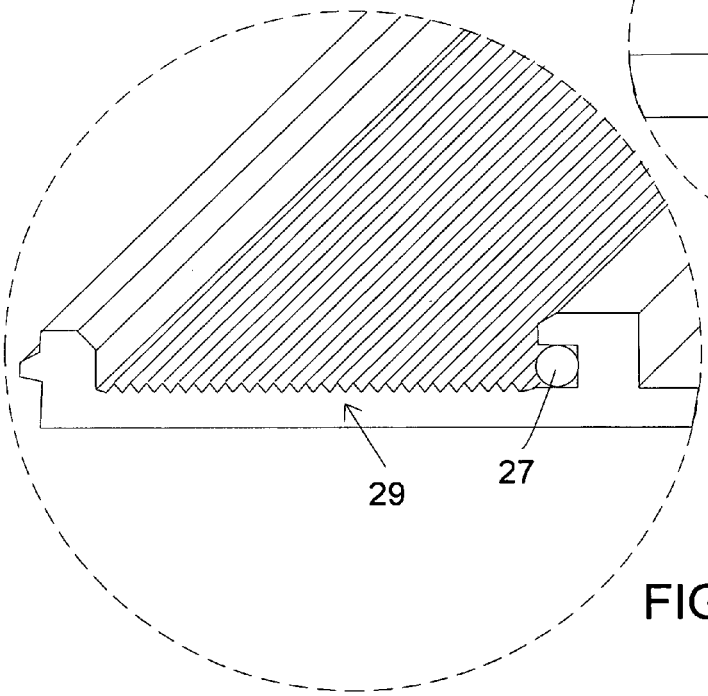
FIG. 6 shows an enlarged view of the micro-grooved rolling surface of FIG. 3.

FIG. 3 shows how the prior art flat wheel rolling surface 18 of rolling channel 15 has been replaced with a micro-grooved surface 29 on both the driver side and the passenger side of the lane section. FIG. 6 gives an enlarged view of the micro-grooved structure 29. The structure is given to the extruded lane section by design of the extrusion die. Although in principle a polymer material could be used in the extrusion process, an aluminum extrusion is chosen for a preferred embodiment. The spacing of the grooves 29 is not critical to obtaining the benefits of the micro-grooved surface, but such spacing should be commensurate with maximizing the fingerprint effect, such an effect being the resistance to lateral cross-track sliding caused by the micro-grooved surface ridges. The sharpness of the ridges formed in the micro-grooved surface depends on the groove angle, but most angles impart some degree of the fingerprint effect. FIG. 4 shows the sawtooth cross-section typical of the entire track, although a combination track using some lane sections from a prior art type track is certainly possible. One benefit of the micro-grooved wheel rolling surface is the reduction in the tendency for the wheels to slip sideways bumping the center guide strip composed of guide rails 26 and 33. In some prior art a solid guide strip is used so there would be a filled area between 26 and 33 but in both cases only the outside edges or sides 20 and 21 contact the wheels. Thus the outside surface of the pair of guide rails are tantamount to a solid strip's outside edges. Also, whereas a flat smooth rolling surface may become coated with graphite during racing, the micro-grooves restore traction on such an especially slippery surface. Another micro-grooved surface benefit is reducing the contact area between the wheel tread surface and the track rolling surface. This reduces the commonly called rolling friction, allowing the car's forward speed to improve.

Low-Friction Guide Rail Insert

Figure 5:
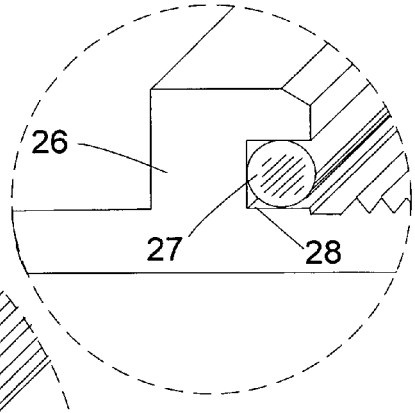
FIG. 5 shows an enlarged view of the low-friction insert of FIG. 3.

Although the micro-grooved surface will tend to keep the car from bumping a center guide strip, occasionally contact between outer edge of the rail 26 and wheel will occur. FIG. 3 shows the insertion of an elongated flexible polymer rod 27 into a groove 28 in the outer edge of rail 26. The rod is inserted as shown by direction arrow 30 and its final position maintained through a pressure fit. FIG. 4 shows the passenger side polymer rod 31 similar to 27. FIG. 5 is an enlarged view of the end of the guide rail 26 showing how the rod 27 fits into the groove 28 as a means for rod attachment. The rod 27 is also shown in an enlarged view of the end of the track lane section in FIG. 6. The polymer rod is a low-friction material selected from the group consisting of the polymers Teflon® and high density polyethylene (HDPE). The key inventive concept here is the use of a low-friction material on the outer edge of a guide strip. There are alternate embodiments, other than a cylindrical rod 27, such as a rectangular rod, that would fit in groove 28 and would serve as a low-friction material for the edge of guide rail 26. Again please note that the 2 guide rails, 26 and 33, as a combination located in a lane center, are collectively known as a low-friction guide strip, the outer edges of which may be touched by the wheels during the guiding process.

Operational Features FIGS. 7-10C

Figure 1:
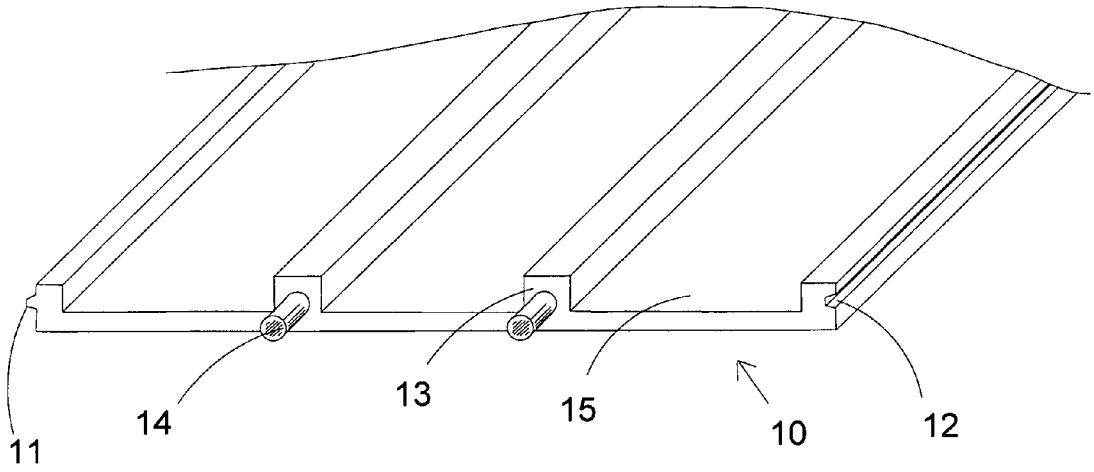
FIG. 1 Prior Art
FIG. 1 shows the end of a prior art race track lane section.
Figure 2:
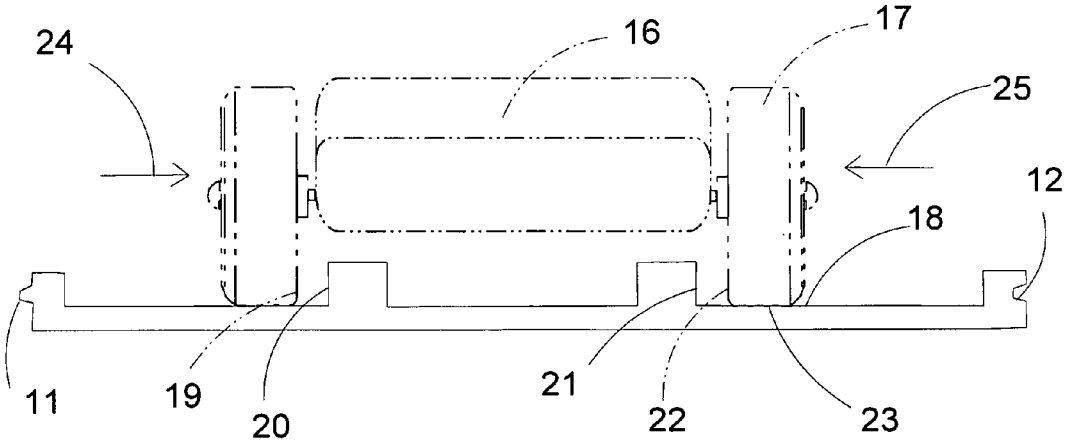
FIG. 2 Prior Art
FIG. 2 shows areas where a racing car interacts with the prior art track.

FIG. 7 compares the present invention's features with the Prior Art FIG. 2. Consider now a side force 25 encountered during racing by a car with body 16. The micro-grooved surface 29 resists the cross-track sliding of the tread surface of wheel 17 to the left with possible eventual contact with the guide rail insert 27. Should the force and motion 25 be substantial, contact between the wheel inner peripheral surface 22 and the low-friction polymer rod 27 will be made. Considering forces that involve movement such as 24 on the passenger side, there the micro-grooved surface 29 will inhibit eventual contact between the wheel and guide rail. But, if there is guide rail contact, it will be between the inner wheel surface 19 and low-friction rod 31.

Some racing cars use so called "racing wheels" which are very thin with sharp treads, shown as 32 in FIG. 8. One feature of the micro-grooved surface used with the broad smooth-tread wheels of FIG. 7 is that the contact area between the track rolling surface and wheel is reduced, thus reducing rolling friction. But as shown in the enlargement of FIG. 9, the micro-grooved surface will also have a "locking in" effect against cross-track motion of the sharp-edged racing wheels, thus wheel contact with the center guide strip will be a rare occurrence.

FIG. 10A shows experimental values for the coefficient of sliding friction (COF) for a polystyrene (PS) wheel on various materials with cross-track or down-track travel directions. Here cross-track means perpendicular to the usual down-track direction of car travel when racing. When one drags an ordinary weighted wheel across an aluminum micro-grooved plate, the force required is 25% higher than the weight of and on a wheel, which by definition gives a COF of 1.25 in a cross-track direction as shown in Row 1 of FIG. 10A. On the other hand, if the aluminum (Al) is smooth, which is typical of prior art tracks, in Row 2 the sideways wheel dragging shows a COF of only 0.34, or substantially 4 times less than the fingerprint effect COF of 1.25. For tracks extruded from a plastic material such as smooth polystyrene (PS), Row 3, or smooth polyethylene (PE), Row 4, the COF for cross-track sliding tendency of a wheel is still close to that for smooth Al. As discussed earlier, although the micro-grooved surface will tend to keep the car from sliding cross-track and bumping the center guide rail, occasionally contact between the rail and wheel will occur. The low-friction material for the guide rail insert 27 has a COF listed in Rows 5 and 6 in FIG. 10A. Tests show that each member of the group consisting of Teflon® and high density polyethylene (HDPE) have essentially the same low COF for sliding against the wheel material, polystyrene (PS). The frictional drag for such smooth sliding for this group is thus about 0.040 or only about 10% of the value of PS sliding on smooth aluminum in Row 2. If there is no micro-grooved surface to slow down cross-track wheel sliding and lessen the impact velocity of a wheel against the low-friction insert the resulting higher impact velocity will cause a higher although momentary COF of the PS wheel against the low-friction insert. FIG. 10B shows the tendency for the COF to increase from the smooth sliding value of 0.04 to a higher value as cross-track bumping velocity increases. There is thus a case to be made for a synergism of the micro-grooved structure's fingerprint effect reducing cross-track sliding velocity with the effect of a low-friction guide rail. In other words, the race car performance improvement of the micro-grooved structure used alone plus the performance improvement of the low-friction guide rail used alone in total is less than the improvement afforded by the combination. Here performance is mostly speed.

FIG. 10C shows results of tests for the polystyrene wheels on smooth glass and smooth aluminum surfaces. The contact area was reduced by using one or more sharp-tread wheels such as 32 in FIG. 8. The data indicate the expected reduction in rolling friction from smooth wheel treads on the micro-grooved surface as compared to the friction from the 100% contact area, or footprint, of smooth wheel treads on a prior art smooth flat rolling surface.

Conclusions, Ramifications, and Scope

The reader can see that the micro-grooved rolling surface and low-friction guide rail can separately improve the speed of a gravity-driven racing car which is a key measure of performance. Moreover, there is a combination effect on friction reduction whereby the micro-grooved surface limits the velocity of wheel impact with the low-friction guide rail insert making the latter more effective in friction reduction. These innovations, along with the reduction in rolling friction afforded by the micro-grooved surface, significantly reduce the loss of energy through friction and thus allow the speed of a car to be more representative of the car itself.

Throughout the history of gravity-driven car racing, a problem frequently encountered is the side-to-side motion of the racing car on the track. Once this motion starts, it tends to continue, thus causing bumping against the guide strip and a poor race time to the finish. The source of the problem is the ease with which a racing car, especially the weighted rear wheels, can slip side-to-side because of the poor traction between a smooth track surface and the rear wheels. And if a lubricant such as graphite coats the rolling surface during the racing process, this loss of traction and guide strip bumping can become worse. But with the micro-grooved surfaces, there is no smooth rolling surface available to become coated, and a simple brushing process can ensure a virgin surface for improved wheel traction.

This application is an extension of recently issued U.S. Pat. No. 8,016,639 B2 "Start Gate for Gravity-Driven Cars", U.S. Pat. No. 8,043,139 B2 "Start Switch for Gravity-Driven Cars", and application Ser. No. 12/806,157 "Cycloid Ramp for Gravity Race Cars". Taken together, these innovations along with the present application will form a quality racing platform that will extend the benefits of interference-free gravity-driven car racing.

While the above invention contains many specificities, these should not be construed as limitations on the scope of any other possible embodiments, but rather as examples of the presently presented embodiments. Thus the scope of the invention should be determined by the appended claims and their legal equivalents, and not by the descriptive examples given.

Advantages

From the descriptions above, a number of advantages of the friction-controlled gravity race track over and above prior art race tracks becomes evident.

1) The micro-grooved rolling surface prevents excessive cross-track motion perpendicular to the direction of travel through an increase in cross-track sliding friction, thus shortening the down-track distance traveled and reducing travel time to the finish line.
2) In the event of side-to-side traction loss, the low-friction guide strip reduces down-track sliding friction energy loss when wheels impact and slide against this guide strip during the guiding process, thereby also improving race times.
3) The micro-groove rolling surface reduces the cross-track velocity of impact of the car wheels with the center guide strip thus reducing frictional drag between the strip and a wheel during the guiding process and further improving race times.
4) The micro-grooved rolling surface in combination with the low-friction guide strip have a synergistic effect because of 3). This is because the coefficient of sliding friction between the wheel and low-friction guide strip in 2) above is reduced by the contact velocity reduction as described in 3) caused by the micro-grooved surface.
5) The small area of contact between the micro-grooved surface and the smooth tread of a racing car wheel substantially reduces rolling friction drag in the down-track direction of motion also resulting in improved race times.
6) Whereas a lubricant such as graphite can coat the smooth rolling surfaces of a flat prior art track during the racing process, the resulting loss of traction that causes guide strip bumping can be greatly reduced by the micro-grooved rolling surfaces of the present invention.

The resulting straight path, improved traction, less rolling friction, reduced bumping against the center guide rail and improved car speed are key measures of the performance of a racing car.

I claim:

1. An improved race track for one or a plurality of gravity-driven racing cars, comprising one or a plurality of one-car lanes, said racing cars comprising a plurality of wheels mounted on a body, and each of said lanes comprising a central guide strip and a means for attaching a low-friction material to each outside edge of said central guide strip to form a combination called a low-friction guide strip, said low-friction guide strip being the specific improvement of said improved race track, and further, the width of said low-friction guide strip being a predetermined amount to allow said wheels mounted on the driver side of said body, and said wheels mounted on the passenger side of said body, to straddle said low-friction guide strip during racing, whereby said low-friction guide strip provides a low-friction contact with said wheels whenever said low-friction guide strip is contacted by said wheels during the guiding process of said racing car.

2. The race track of claim 1 wherein said means for attaching said low-friction material is a groove along each outer edge of said guide strip, said groove being a predetermined size suitable for insertion of and holding of a low-friction polymer rod, said rod being one embodiment of said low-friction material.

3. The race track of claim 2 wherein said low-friction polymer rod is an elongated rod selected from the group consisting of Teflon® and high density polyethylene (HDPE).

4. The race track of claim 1 wherein said low-friction material protrudes from each outside edge of said central guide strip a predetermined amount so that the inside surface of said wheels mounted on the driver-side of said body and the inside surface of wheels mounted on the passenger side of said body will contact said low-friction material rather than contacting the substantially higher friction edge of said guide strip itself during said racing car's guiding process.

5. An improved race track for one or a plurality of gravity-driven racing cars, said track comprising one or a plurality of one-car lanes and said racing car comprising a plurality of wheels mounted on a body, and (a) each of said lanes further comprising a first improvement consisting of a pair of micro-grooved wheel rolling surfaces, with one of said pair positioned on one side of a central guide strip and the other of said pair positioned on the opposite side of said central guide strip, with said micro-grooved wheel rolling surfaces having a regular sawtooth cross-section resulting in a series of numerous and contiguous v-shaped grooves placed side-by-side in a parallel fashion and running in a down-track direction, forming thereby a series of inverted v-shaped side-by-side ridges with the tips of said ridges being the support touching the bottom of said racing car wheels, and one of said pair of micro-grooved wheel rolling surfaces supporting said wheels mounted on the driver side of said body, and the other of said pair of micro-grooved wheel rolling surfaces positioned to support said wheels mounted on the passenger side of said body, with said micro-grooved surfaces extending from the edge of the central guide strip to substantially the nearest edge of said rolling surface;

(b) said ridges formed by said micro-grooved wheel rolling surfaces behaving as a non-skid surface, thus causing a resistance to motion in a cross-track lateral direction substantially higher than resistance of a smooth surface, said resistance thereby tending to lower said wheel's cross-track velocity when said wheel is urged to move in said cross-track direction, said cross-track direction being substantially perpendicular to said down-track direction;

(c) each of said lanes further comprising a means for attaching a low-friction material to each outside edge of said central guide strip to form a combination called a low-friction guide strip, said low-friction guide strip being a second improvement of said improved race track, the width of said low-friction guide strip being a predetermined amount to allow said plurality of wheels mounted on the driver side of said body, and said plurality of wheels mounted on the passenger side of said body, to straddle said low-friction guide strip during racing, with said low-friction guide strip providing a low-friction contact with said wheels whenever said low-friction guide strip is contacted by said wheels during said racing car's guiding process;

(d) during said racing car's guiding process said low-friction material providing a minimal resistance to a down-track motion of said car when contacted by said wheel at a low velocity, but providing a higher resistance to said down-track motion when contacted by said wheel at a substantially higher velocity;

(e) said first improvement, being said pair of micro-grooved wheel rolling surfaces positioned on either side of a central guide strip, when taken in combination with said second improvement, being said low-friction guide strip, said combination thereby showing a synergistic effect in that said wheel cross-track velocity, being reduced by said micro-grooved surfaces, causes said low-friction guide strip to be made more effective by reducing its resistance to down-track motion when contacted by said wheel at said low velocity;

(f) said ridges formed by said micro-grooved wheel rolling surfaces serving to decrease the coefficient of rolling friction for motion in said down-track direction of travel of said racing car, the amount of said rolling friction being proportional to the instantaneous common contact area between said wheel surface and said rolling surface, said rolling friction caused by a microscopic adhesion of said wheel surface to said rolling surface wherein an amount of kinetic energy of motion is lost when said amount is instead used to allow said wheel surface to break the adhesive force tending to adhere it to said rolling surface, thus said rolling friction being a maximum when a smooth wheel surface contacts a smooth and flat rolling surface and a minimum when said smooth wheel surface contacts only the relatively small surface area of the tips of said ridges;

whereby, when said first improvement using said micro-grooved wheel rolling surfaces and said second improvement using said low-friction central guide strip are used together, the combination will reduce the undesirable friction between said race car and said track even more than if the two are applied separately, and based on the physics that the reduction in undesirable friction will cause less kinetic energy loss and thus a higher velocity of said racing cars, it is therefore apparent, by reducing the undesirable effect of said track in reducing said car velocity, that said improvements will allow the final velocity of said racing car and its chance of winning to be more dependent on just the car itself .

6. The race track of claim 5 wherein said means for attaching said low-friction material is a groove along each outside edge of said guide strip, said groove being a predetermined size suitable for insertion of and holding of a low-friction polymer rod, said rod being one embodiment of said low-friction material.

7. The race track of claim 6 wherein said low-friction polymer rod is an elongated rod selected from the group consisting of Teflon® and high density polyethylene (HDPE).

8. The race track of claim 5 wherein said low-friction material protrudes from the outside edges of said central guide strip a predetermined amount so that the inside of said wheels mounted on the driver-side of said body and the inside of wheels mounted on the passenger side of said body will contact said low-friction material rather than contacting the higher friction surface of said guide strip itself during said racing car's guiding process.

* * * * *